US007149313B1

(12) United States Patent
Allen

(10) Patent No.: US 7,149,313 B1
(45) Date of Patent: Dec. 12, 2006

(54) AUDIO SIGNAL PROCESSING

(75) Inventor: William A. Allen, Westborough, MA (US)

(73) Assignee: Bose Corporation, Farmingham, MA (US)

( * ) Notice: Subject to any disclaimer, the term of this patent is extended or adjusted under 35 U.S.C. 154(b) by 0 days.

(21) Appl. No.: 09/312,916

(22) Filed: May 17, 1999

(51) Int. Cl.
*H04R 5/00* (2006.01)

(52) U.S. Cl. ..... 381/22; 381/18; 381/19; 381/20; 381/307

(58) Field of Classification Search ..... None
See application file for complete search history.

(56) References Cited

U.S. PATENT DOCUMENTS 5,666,424 A 9/1997 Fosgate et al.
6,711,266 B1 * 3/2004 Aylward ..... 381/22
7,016,501 B1 * 3/2006 Aylward et al. ..... 381/22

FOREIGN PATENT DOCUMENTS

JP 08340600 6/1995
WO WO 91/19407 12/1991

* cited by examiner

*Primary Examiner*—Laura A. Grier
(74) *Attorney, Agent, or Firm*—Fish & Richardson P.C.

(57) ABSTRACT

A method and apparatus for processing multi-channel audio signals in which the channels are processed by one of alternatively selectable processes to produce an alternatively selectable number of output channels, the process being responsive to information contained in the input signal.

33 Claims, 2 Drawing Sheets

AUDIO SIGNAL PROCESSING

Figure 1:
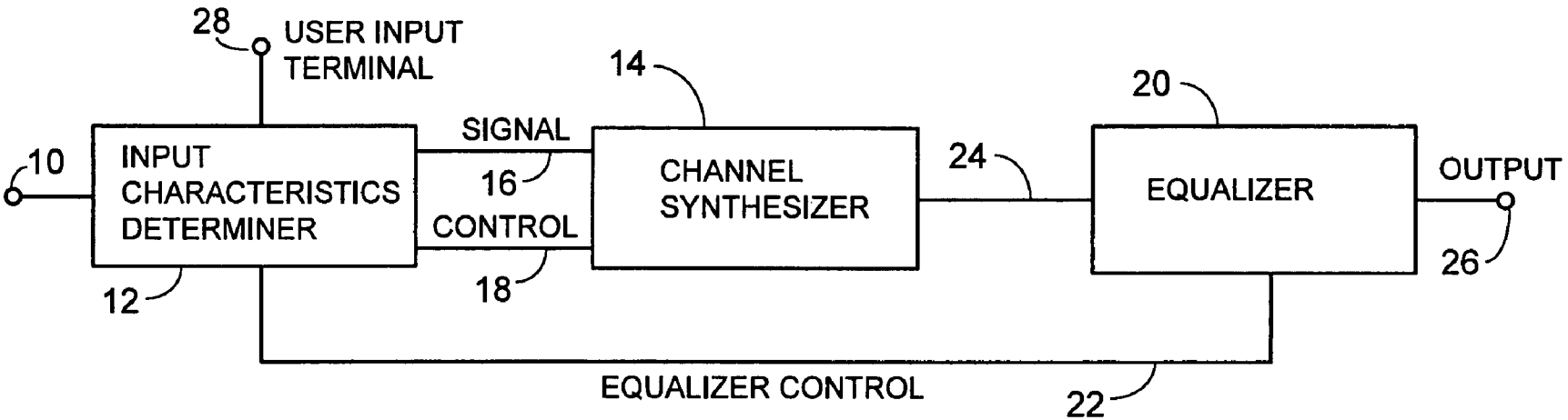

The invention relates to the processing of audio signals, and more particularly to the processing of audio signals having varying numbers of directional channels and varying equalization characteristics.

It is an important object of the invention to provide an improved system for processing audio signals by detecting certain characteristics of the audio signals and processing the signals to produce an output signal having a desirable number of channels and low frequency equalization characteristics.

According to the invention, a method for processing an audio signal having one or more directional input channels includes detecting the number and directional designators of the directional input channels; and processing each of the directional input channels by one of a plurality of selectable processes, the selectable process applied to each directional input channel being responsive to the detecting step according to a predetermined pattern without user intervention.

In an other aspect of the invention, a method for processing an audio signal having one or more directional input channels includes detecting the number and directional designators the directional input channels; and processing the directional input channels to produce an alternatively selectable number of output directional channels, the alternatively selectable number of output directional channels and the contents of the output directional channels being responsive to the detecting step according to a predetermined pattern without user intervention.

In another aspect of the invention, a method for processing an audio signal includes determining whether the audio signal is an analog signal or a digital signal; responsive to a determining that the signal is an analog signal, decoding the signal to produce a left channel, a right channel, a center channel, a left surround channel and a right surround channel; responsive to a determining that the audio signal is a digital signal, detecting the number and directional designators of directional input channels in the audio signal; and processing each of the directional input channels by one of a plurality of selectable processes, the selectable process applied to each directional input channel being responsive to the detecting step according to a predetermined pattern without user intervention.

In another aspect of the invention, a method for processing an audio signal includes determining whether the audio signal is an analog signal or a digital signal; responsive to a determining that the signal is an analog signal, decoding the signal to produce a left channel, a right channel, a center channel, a left surround channel and a right surround channel; responsive to a determining that the audio signal is a digital signal, detecting the number and directional designators of directional input channels in the audio signal; and processing the directional input channels to produce a plurality of output directional channels, the number of output directional channels and the directional designators of the output directional channels being responsive to the detecting step according to a predetermined pattern without user intervention.

In another aspect of the invention, a method for processing an audio signal having one or more directional input channels includes detecting the number of surround channels in the audio signal and processing the directional input channels by one of a plurality of selectable processes to produce two stereo surround directional output channels, the selectable process applied to the directional input channels being responsive to the detecting step according to a predetermined pattern without user intervention.

In another aspect of the invention, a method for processing an audio signal includes determining whether the audio signal has been equalized for a large room and responsive to a determining that the audio signal has been equalized for a large room, applying a pre-selected gain below a threshold frequency.

In another aspect of the invention, an apparatus for processing an audio signal having one or more directional input channels includes an input characteristics determiner for detecting the number and directional designators of the directional input channels; and a processor for processing each of the directional input channels, the processor being designed and constructed to process the audio signal by one of a plurality of selectable processes, the selectable process applied to each directional input channel being responsive to the input characteristics determiner according to a predetermined pattern without user intervention.

In another aspect of the invention, an apparatus for processing an audio signal having one or more directional input channels includes an input characteristics determiner for detecting the number and directional designators of the directional input channels and a processor for processing the directional input channels, the processor being designed and constructed to produce an alternatively selectable number of output directional channels, the number of output directional channels and the contents of the output directional channels being responsive to the input characteristics determiner according to a predetermined pattern without user intervention.

In another aspect of the invention, an apparatus for processing an audio signal includes an input characteristics determiner for determining whether the audio signal is an analog signal or a digital signal and for determining the number and directional designators of digital signals; a first processor, responsive to the input characteristics determiner for decoding the analog signals to produce a left channel, a right channel, a center channel, a left surround channel and a right surround channel; and a second processor, responsive to the input characteristics determiner, for processing each of the directional input channels of the digital signals by one of a plurality of selectable processes, the selectable process applied to each directional input channel being responsive to the input characteristics determiner according to a predetermined pattern without user intervention.

In another aspect of the invention, an apparatus for processing an audio signal includes an input characteristics determiner for determining whether the audio signal is an analog signal or a digital signal and for determining the number and directional designators of channels in the digital signals; a decoder, responsive to the input characteristics determiner for decoding the analog signals to produce a left channel, a right channel, a center channel, a left surround channel and a right surround channel; and a processor, for processing the directional input channels in the digital signals to produce a plurality of output directional channels, the number of output directional channels and the directional designators of the output directional channels being responsive to the input characteristics determiner according to a predetermined pattern without user intervention.

In still an other aspect of the invention, an apparatus for processing an audio signal includes an input characteristics determiner for determining whether the audio signal has been equalized for a large room and an equalizer, responsive to the determiner, for applying a pre-selected gain below a threshold frequency.

Figure 2:
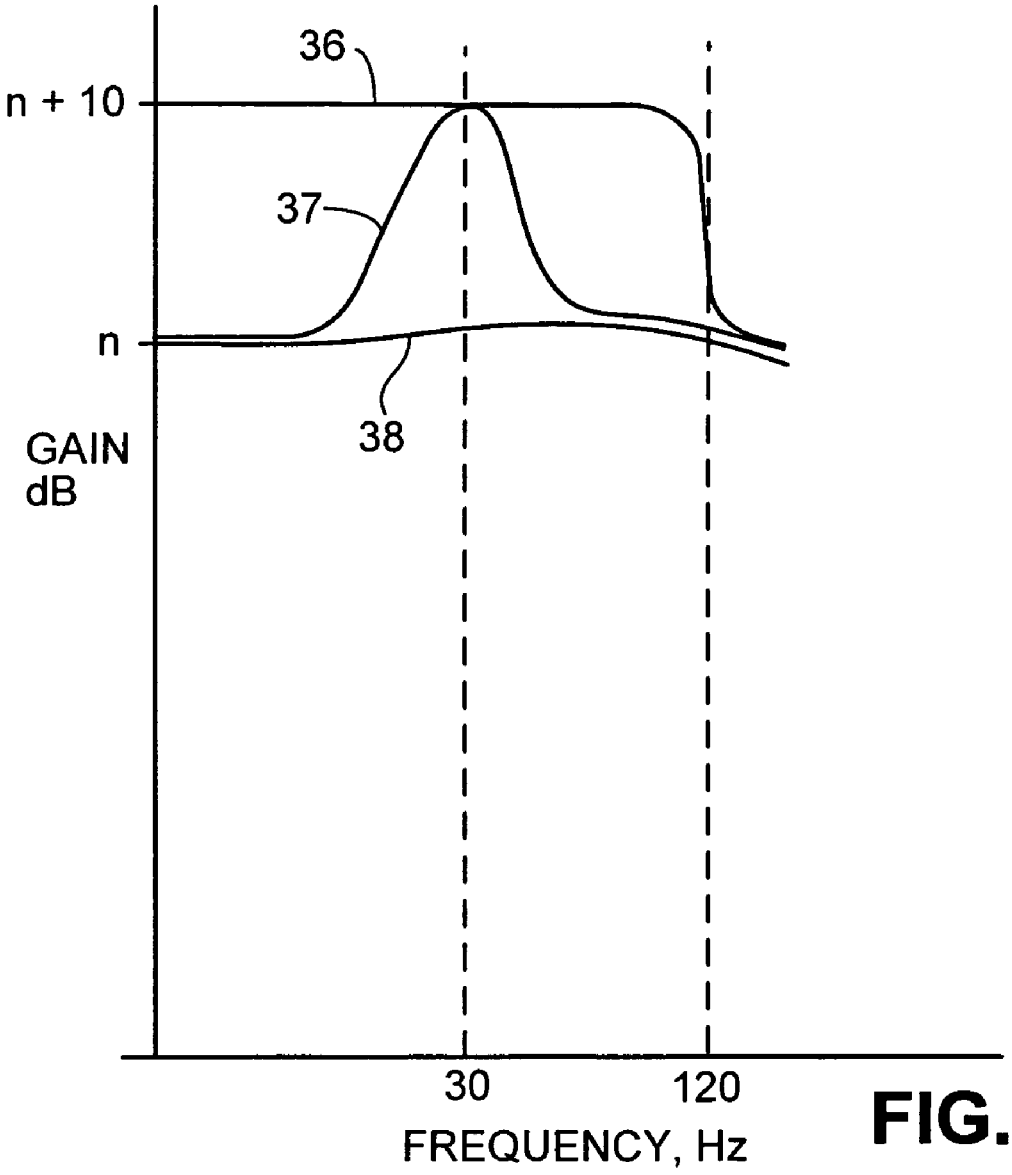

Other features, objects, and advantages will become apparent from the following detailed description, which refers to the following drawings in which:

FIG. 1 is a logical arrangement of an audio signal processing system according to the invention; and FIG. 2 is a set of equalization curves helpful in describing the low frequency equalization aspect of the invention.

With reference now to the drawings and more particularly to FIG. 1, there is shown a block diagram of a system according to the invention. Audio signal source 10 and user input terminal 28 are coupled to input characteristics determiner 12, which is in turn coupled to directional channel synthesizer 14 by signal line 16 and directional channel synthesizer control line 18, and to equalizer 20 by equalizer control line 22. Directional channel synthesizer 14 is coupled to equalizer 20 by signal line 24. Equalizer 20 is coupled to output terminal 26.

In operation, input characteristics determiner 14 determines certain characteristics about the input audio signal received from audio signal source 10. Based on the characteristics of the input audio signal, and in some circumstances on input received from user input terminal 28, input characteristics determiner 12 determines, according to a predetermined formula, the processing to be performed by directional channel synthesizer 14 and the equalization to be performed by equalizer 20. The signals are then processed by directional channel synthesizer 14 and equalizer 20 and output at output terminal 26.

Input terminal 28 and output terminal 26 are shown diagrammatically as single lines. In a physical embodiment of the system, input terminal 26 may include multiple input terminals, for example two analog input terminals and a digital input terminal.

Input characteristics determiner 14 may include logic to determine whether the audio signal is analog or digital and the number of directional channels in the input audio signal. The logic may include detectors for detecting whether an input signal is present on a digital input terminal or one or more of the analog input terminals, and may be further modified by user settings. For example, the system may have an input selector including a setting for FM radio reception, in which case the logic determines the audio signal is analog. If the signal is a digital signal, the logic may read information in a header in the digital signal to determine the number of directional channels.

Directional channel synthesizer 14 may include one or more of a variety of audio signal processing systems, such as Pro Logic or AC-3, available from Dolby Laboratories Licensing Corporation of San Francisco, Calif., Circle Surround available from RSP Technologies of Rochester Hills, Mich., or systems as described in co-pending U.S. patent application Ser. No. 08/796,285, or other analog or digital decoding systems which decode audio signals into multiple directional channels.

"Directional input channels" as used herein refers to audio information that is encoded in such a manner that it can be decoded and reproduced at a location relative to a listener, so that the listener perceives the sound as originating from a direction in space. Directional input channels are typically designated by a directional designator, such as "left," "right," "center," "surround," "left surround" and "right surround," depending on the direction from which it is intended the decoded sound is perceived to come. For the purposes of this application, the number of directional input channels in an audio signal is determined by the number of input channels that are unique. Some audio signals may contain more than one directional input channel, but the information in two or more of the directional channels may not be unique, in which case the two or more directional channels are counted as one. A one-directional channel audio signal is referred to as a "monophonic" audio signal. A multi-directional channel audio signal, which has only one surround channel or which has a left surround channel and a right surround channel that are correlated and in phase, is referred to as a signal having "monophonic surround." A multi-directional channel audio signal which has two surround channels is referred to as a signal having "stereo surround."

"Directional output channels" as used herein are decoded input channels suitable for reproduction by a loudspeaker, typically placed relative to the listener at a position from which the sound is intended to come. So, for example, the "left output channel" contains information intended to be reproduced by a loudspeaker placed to the left of a listener.

Some audio signals may have a portion that is spectrally limited, that is contains only frequencies in a frequency range, but which are not encoded in a manner such that it can be decoded so that the listener perceives the sound coming from a direction in space. While such portions are sometimes referred to as a bass channel, a low frequency effects channel or a low frequency equalization channel, these portions may not be "directional channels" as defined above. Such spectrally limited channels frequently contain the radiation in a frequency range from all the directional channels, so that the directional channels contain substantially only the remaining frequencies. Some directional channel synthesizing systems may filter out a frequency band from an audio signal and use the filtered frequency band to create a directional channel.

Audio signals may be transmitted as more than one signal component, typically transmitted along separate physical paths. A typical stereophonic audio signal, for example, is transmitted as two components, designated as "left" and "right." While these components are sometimes referred to as "channels," they may not be "directional channels" as defined above. In a stereophonic system, each signal component does represent a directional channel, but in an analog surround encoded system, two signal components may represent three, four, or five directional channels. To avoid confusion, these components will be referred to as "signal components" in this disclosure.

If the directional channel characteristics determiner 12 determines that the signal is digital, the process performed by the directional channels synthesizer 14 is according to Table 1. For some combination of directional channels present in the audio input signal, there may be a default action performed by the directional channel synthesizer 14, and an alternative user selectable process. The user can select the alternate process by inputting a request at user input terminal 28, If no user request is input, the directional channel synthesizer performs the default action.

If the input determiner determines that the input signal is analog, the processing performed by directional channel synthesizer 14 may be dependent on user input (such as processing discretely input specified as CD or FM, and decoding input specified as video into five directional channels) or, if combined with a system for determining the number and directional designator of directional channels encoded in the analog signals (for example, requesting the user to specify the number and directional designators of the directional channels) processing the analog signals according to Table 1. In one embodiment, the directional channels synthesizer decodes all analog inputs into five directional channels.

TABLE 1

| Directional channels Present in Audio Input Signal | Action Performed by Output Directional Channel Synthesizer | Notes |
|---|---|---|
| Left (L), Right (R), Center (C), Left Surround (LS), Right Surround (RS) | Process directional channels discretely. | |
| L, R, C | Process C discretely; process L and R to provide LS and RS | |
| L, R, LS, RS | Process directional channels discretely or Process L and R to provide C | Default<br>if selected by user |
| L, R, C, monophonic surround S (i.e. LS = RS) | Process L and R according to $L_{new} = L + .707S$ $R_{new} = R - .707S$; process $L_{new}$ and $R_{new}$ to provide LS and RS | |
| L, R, S | L and R processed according to $L_{new} = L + .707S$ $R_{new} = R - .707S$; process $L_{new}$ and $R_{new}$ to provide LS, RS, and C | |
| L, R | Process L and R to form, C, LS, and RS or process L (or R) to form $L_{new}$, $R_{new}$, C, LS, RS | Default<br>if selected by user (useful, for example, if input is monophonic transmitted as stereo i.e. L = R) |
| C (i.e. monophonic) | C processed to form $C_{new}$, L, R, LS and RS | |

Input characteristics determiner 12 further includes logic which determines the equalization characteristics of the input signal by reading information in digital audio signals that are encoded to contain such information in the digital bitstream. An example is the Dolby AC-3 encoding system that identifies the room type ("roomtyp" control word) the audio signal was equalized for, whether or not the digital signals are surround encoded ("dsurrmod" control word) the presence or absence of a low frequency effects (LFE) channel ("lfeon" control word), which is a channel containing bass energy below about 120 Hz. Based on the determined characteristics, the input characteristics determiner 12 signals the equalizer 20 to apply a low frequency equalization to the audio signal.

Referring to FIG. 2, there is shown a set of equalization curves helpful in explaining the low frequency aspect of the equalizer 20. If there is an LFE channel, the LFE frequency range is boosted by 10 dB as indicated by curve 36. If there is no LFE channel, the input characteristics determiner 12 determines the room type and whether the audio signal is surround encoded and applies a low frequency boost according to Table 2. The low frequency boost has a 10 dB second order peak centered at 30 Hz, as indicated by curve 37. If the system has a dynamic equalizer, the equalizer acts in a supplementary fashion with the dynamic equalizer to apply a gain of 10 dB. So, for example, if the dynamic equalizer applies a gain of 10 dB or more, equalizer 20 applies no additional gain. If the dynamic equalizer applies a gain of less than 10 dB, equalizer 20 applies a gain equal to the difference between 10 dB and the gain applied by the dynamic equalizer. For reference, curve 38, which has no LFE channel, and no low frequency boost, is also shown.

TABLE 2

| Determined Input Characteristics | | | | | |
|---|---|---|---|---|---|
| Is LFE present? | Room Type | Surround Encoded? | Apply 10dB LFE boost? | Apply Low Freq. Film EQ gain? | User Apply Low Freq. Film EQ gain? |
| No | Not Known | Not Known | No | No | Yes |
| No | Not Known | No | No | No | Yes |
| No | Not Known | Yes | No | Yes | |
| No | Large | Not Known | No | Yes | |
| No | Large | No | No | Yes | |
| No | Large | Yes | No | Yes | |
| No | Small | Not Known | No | No | Yes |
| No | Small | No | No | No | Yes |
| No | Small | Yes | No | No | |
| Yes | All Cases | All Cases | Yes | No | |

A system according to the invention is advantageous because it provides a desired number of audio directional channels with an appropriate low frequency equalization, without requiring the user to find out the characteristics of the input signal, to know the appropriate low frequency equalization for a source, or to manually set the directional channel configuration or equalization curve.

Other embodiments are within the claims.

What is claimed is:

1. A method for processing an audio signal having one or more directional input channels, comprising:

detecting the number and directional designators of said directional input channels; and processing each of said directional input channels by one of a plurality of selectable processes, the selectable process applied to each directional input channel being responsive to said detecting step according to a predetermined pattern without user intervention.

2. A method for processing an audio signal in accordance with claim 1, wherein said selectable processes include a process which includes combining said directional input channel with an other directional input channel.

3. A method for processing an audio signal in accordance with claim 2, wherein said process includes attenuating said other directional input channel.

4. A method for processing an audio signal in accordance with claim 2, wherein said selectable processes include a process which includes phase shifting said other directional input channel.

5. A method for processing an audio signal in accordance with claim 1, wherein said predetermined pattern includes, responsive to said detecting step detecting a monophonic surround channel, a left channel signal, and a right channel signal, a selectable process that includes processing said left channel signal to produce a modified left channel signal and processing said right channel signal to produce a modified right channel signal.

6. A method for processing an audio signal in accordance with claim 5, wherein said modified left channel signal and said modified right channel signal include a surround channel component, and where said left channel surround channel component and said right channel surround channel component are out of phase.

7. A method for processing an audio signal in accordance with claim 1, wherein said processing produces a number of output directional channels, said number of output directional channels and the directional designators of said output directional channels being responsive to said detecting step according to a predetermined pattern.

8. A method for processing an audio signal having one or more directional input channels, comprising:

detecting the number and directional designators of said directional input channels; and processing said directional input channels to produce an alternatively selectable number of output directional channels, said alternatively selectable number of output directional channels and the contents of said output directional channels being responsive to said detecting step according to a predetermined pattern without user intervention.

9. A method for processing an audio signal in accordance with claim 8, wherein said alternatively selectable numbers includes only numbers equal and greater than said number of directional input channels.

10. Method for processing an audio signal in accordance with claim 8 wherein said number of input channels is a number from one to five, inclusive, and where said alternatively selectable number includes four and five.

11. A method for processing an audio signal, comprising:

determining whether said audio signal is an analog signal or a digital signal;

responsive to a determining that said signal is an analog signal, decoding said signal to produce a left channel, a right channel, a center channel, a left surround channel and a right surround channel;

responsive to a determining that said audio signal is a digital signal, detecting the number and directional designators of directional input channels in said audio signal; and processing each of said directional input channels by one of a plurality of selectable processes, the selectable process applied to each directional input channel being responsive to said detecting step according to a predetermined pattern without user intervention.

12. A method for processing an audio signal in accordance with claim 11, wherein said selectable processes include a process which includes combining said directional input channel with an other directional input channel.

13. A method for processing an audio signal in accordance with claim 12, wherein said process includes attenuating said other directional input channel.

14. A method for processing an audio signal in accordance with claim 11, wherein said selectable processes include a process which includes phase shifting and combining with an other directional input channel.

15. A method for processing an audio signal in accordance with claim 11, wherein said predetermined pattern includes, responsive to said detecting step detecting a monophonic surround channel, a left channel signal, and a right channel signal, a selectable process that includes processing said left channel signal to produce a modified left channel signal and processing said right channel signal to produce a modified right channel signal.

16. A method for processing an audio signal in accordance with claim 15, wherein said modified left channel signal and said modified right channel signal include a surround channel component, and where said left channel surround channel component and said right channel surround channel component are out of phase.

17. A method for processing an audio signal in accordance with claim 11, wherein said processing produces a number of output directional channels, said number of output directional channels and the directional designators of said output directional channels being responsive to said detecting step according to a predetermined pattern.

18. A method for processing an audio signal, comprising:

determining whether said audio signal is an analog signal or a digital signal;

responsive to a determining that said signal is an analog signal, decoding said signal to produce a left channel, a right channel, a center channel, a left surround channel and a right surround channel;

responsive to a determining that said audio signal is a digital signal, detecting the number and directional designators of directional input channels in said audio signal; and processing said directional input channels to produce a plurality of output directional channels, the number of output directional channels and the directional designators of said output directional channels being responsive to said detecting step according to a predetermined pattern without user intervention.

19. A method for processing an audio signal in accordance with claim 18, wherein said selectable processes include a process which includes combining said directional input channel with an other directional input channel.

20. A method for processing an audio signal in accordance with claim 19, wherein said process includes attenuating said other directional input channel.

21. A method for processing an audio signal in accordance with claim 18, wherein said selectable processes include a process which includes phase shifting and combining with an other directional input channel.

22. A method for processing an audio signal in accordance with claim 18, wherein said predetermined pattern includes, responsive to said detecting step detecting a monophonic surround channel, a left channel signal, and a right channel signal, a selectable process that includes processing said left channel signal to produce a modified left channel signal and processing said right channel signal to produce a modified right channel signal.

23. A method for processing an audio signal in accordance with claim 22, wherein said modified left channel signal and said modified right channel signal include a surround channel component, and where said left channel surround channel component and said right channel surround channel component are out of phase.

24. A method for processing an audio signal in accordance with claim 18, wherein said processing produces a number of output directional channels, said number of output directional channels and the directional designators of said output directional channels being responsive to said detecting step according to a predetermined pattern.

25. A method for processing an audio signal having one or more directional input channels, comprising:

detecting the number of surround channels in said audio signal; and processing said directional input channels by one of a plurality of selectable processes to produce two stereo surround directional channels, the selectable process applied to said directional input channels being responsive to said detecting step according to a predetermined pattern without user intervention.

26. A method for processing an audio signal in accordance with claim 25, wherein said number of surround channels is zero.

27. An apparatus for processing an audio signal having one or more directional input channels, comprising:

a input characteristics determiner for detecting the number and directional designators of said directional input channels; and a processor for processing each of said directional input channels, said processor being designed and constructed to process said audio signal by one of a plurality of selectable processes, the selectable process applied to each directional input channel being responsive to said input characteristics determiner according to a predetermined pattern without user intervention.

28. An apparatus for processing an audio signal in accordance with claim 27, wherein said processor is designed and constructed to produce a number of output directional channels, said number of output directional channels and the directional designators of said output directional channels being responsive to said input characteristics determiner according to a predetermined pattern.

29. An apparatus for processing an audio signal having one or more directional input channels, comprising:

an input characteristics determiner for detecting the number and directional designators of said directional input channels; and a processor for processing said directional input channels, said processor being designed and constructed to produce an alternatively selectable number of output directional channels, the number of output directional channels and the contents of said output directional channels being responsive to said input characteristics determiner according to a predetermined pattern without user intervention.

30. An apparatus for processing an audio signal having at least one directional input channel, comprising:

an input characteristics determiner for determining whether said audio signal is an analog signal or a digital signal and for determining the number and directional designators of said directional input channels;

a first processor, responsive to said input characteristics determiner for decoding said analog signals to produce a left channel, a right channel, a center channel, a left surround channel and a right surround channel; and a second processor, responsive to said input characteristics determiner, for processing each of said directional input channels of said digital signals by one of a plurality of selectable processes, the selectable process applied to each directional input channel being responsive to said input characteristics determiner according to a predetermined pattern without user intervention.

31. An apparatus for processing an audio signal in accordance with claim 30, wherein said processor is designed and constructed to produce an alternatively selectable number of output directional channels, said number of output directional channels and the directional designators of said output directional channels being responsive to said detecting step according to a predetermined pattern.

32. An apparatus for processing an audio signal having at least one directional input channel, comprising:

an input characteristics determiner for determining whether said audio signal is an analog signal or a digital signal and for determining the number and directional designators of said directional input channels;

a decoder, responsive to said input characteristics determiner for decoding said analog signals to produce a left channel, a right channel, a center channel, a left surround channel and a right surround channel; and a processor, for processing said directional input channels of said digital signals to produce a plurality of output directional channels, the number of output directional channels and the directional designators of said output directional channels being responsive to said input characteristics determiner according to a predetermined pattern without user intervention.

33. An apparatus for processing an audio signal in accordance with claim 32, wherein said processor being constructed and arranged to produce a alternatively selectable number of output directional channels, said alternatively selectable number of output directional channels and the directional designators of said output directional channels being responsive to said detecting step according to a predetermined pattern.

* * * * *